US006347635B1

(12) United States Patent
Jenkins et al.

(10) Patent No.: US 6,347,635 B1
(45) Date of Patent: Feb. 19, 2002

(54) NAIL MACHINE

(75) Inventors: Nevin C. Jenkins, Homosassa; Antonio Lebron, Spring Hill, both of FL (US); Bie Daoting, Guangzhou (CN)

(73) Assignee: Fashion Nails, Inc., Homosassa, FL (US)

( * ) Notice: Subject to any disclaimer, the term of this patent is extended or adjusted under 35 U.S.C. 154(b) by 0 days.

(21) Appl. No.: 09/686,721

(22) Filed: Oct. 11, 2000

(51) Int. Cl.[7] ..... A45D 29/00
(52) U.S. Cl. ..... 132/73
(58) Field of Search ..... 132/73, 285, 200; 101/33, 163, 166, 193, 41

(56) References Cited

U.S. PATENT DOCUMENTS 2,524,322 A * 10/1950 Lipnicki et al. ..... 132/285
2,701,520 A * 2/1955 Rider ..... 101/163
3,598,685 A * 8/1971 Lee et al. ..... 132/73
4,803,922 A * 2/1989 Dennesen ..... 101/41
5,090,320 A * 2/1992 Nave ..... 101/41
5,133,369 A * 7/1992 Billings ..... 132/73
5,269,330 A * 12/1993 Hayes ..... 132/73
5,302,224 A * 4/1994 Jenkins et al. ..... 101/163
5,316,026 A * 5/1994 Jenkins ..... 132/285

* cited by examiner

*Primary Examiner*—John J. Wilson
*Assistant Examiner*—Robyn Kieu Doan
(74) *Attorney, Agent, or Firm*—Martin Fleit; Paul Bianco

(57) ABSTRACT

A hand operated self-contained apparatus for applying an image on a nail of a person's digit or an object that has an integrally molded base having a reference line indicated and a supporting area for receiving an image creating plate containing at least one image for creating thereon an image composed of an image defining coating material. A digit positioning member is mounted on the base and positions a person's digit relative to the location of the created image. A transfer member is mounted on the base and moves between the image creating plate and the person's nail. The transfer member contains a squeegee for removing excess coating material from an image and a pick up pad for picking up a created image. The positioning member has one element mounted and biased for movement vertically for holding the end of the digit and another element mounted and biased for movement horizontally against which the end of the digit or object abuts.

14 Claims, 7 Drawing Sheets

NAIL MACHINE

BACKGROUND OF THE INVENTION

1. Field of Invention

The present invention relates to a machine to put decorative images on nails, such as fingernails and toenails.

2. Prior Art

Recently, there have been several machines introduced for the purpose of applying images to nails. Most of the proposals have been regarding machines that would be more aptly used by nail salons. There remains a need for a machine that is more suitable for the retail market, one that can be used by ordinary people in their homes.

SUMMARY OF THE INVENTION

Accordingly, it is an object of the present invention to provide a novel nail machine that will be capable of being manufactured at low cost and which can easily be used by ordinary people in their homes. Other and further objects and advantages of the present invention will become more readily apparent from the following detailed description of a preferred embodiment when taken with the appended drawings.

DETAILED DESCRIPTION OF PREFERRED SPECIFIC EMBODIMENT

Figure 1:
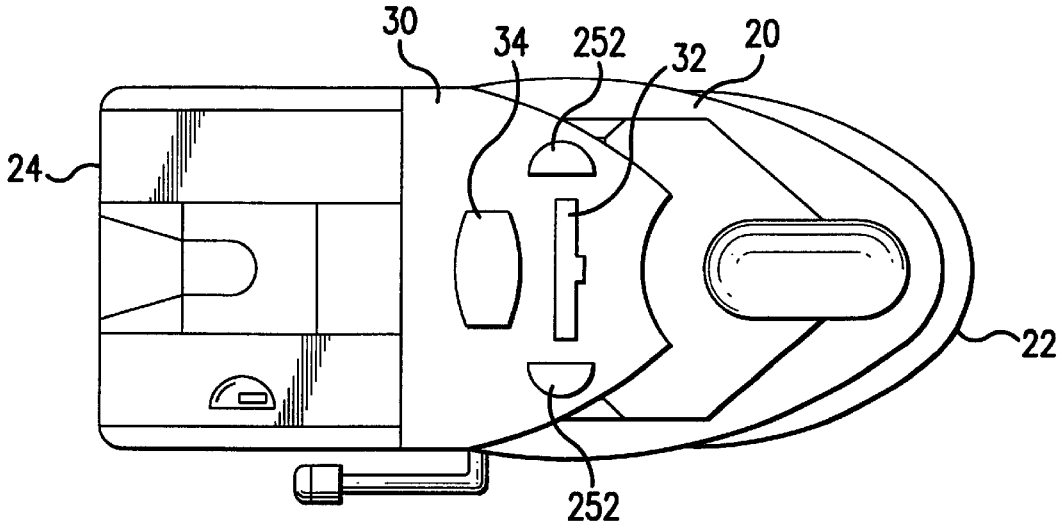
FIG. 1 is top view of the assembled novel machine of the present invention.
Figure 7:
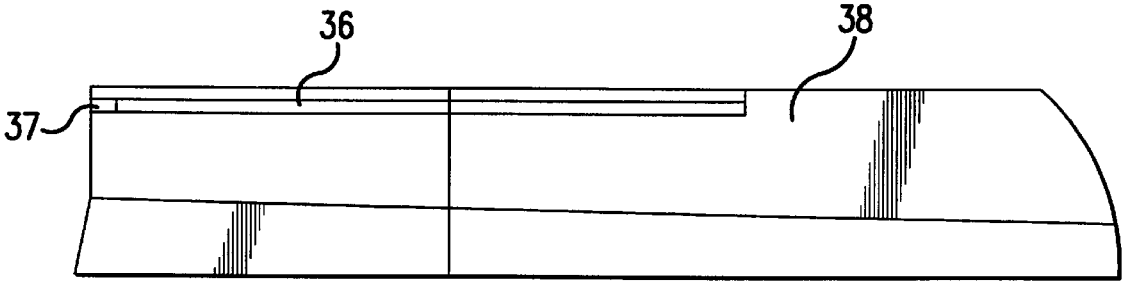
FIG. 7 is side view of the base member.
Figure 2:
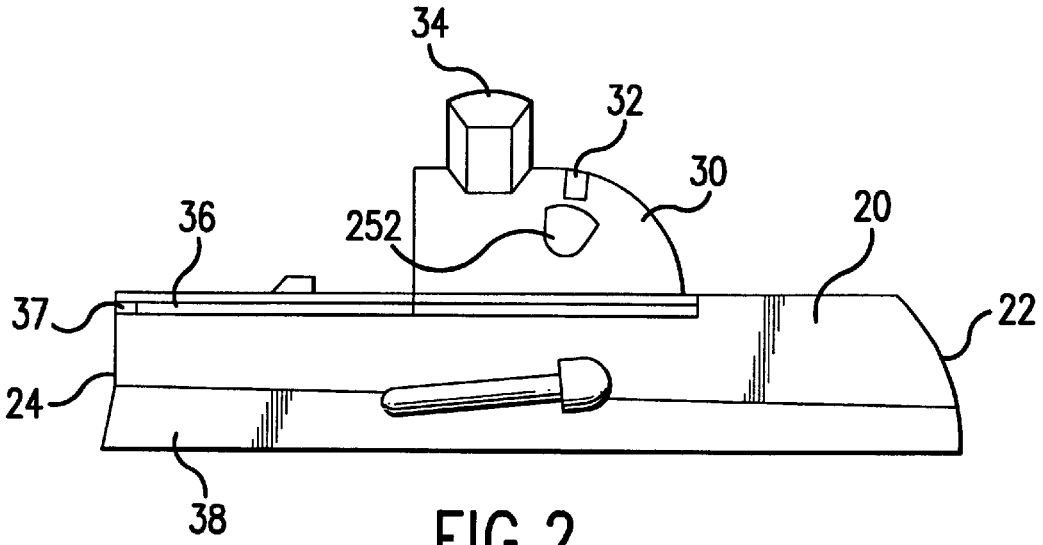
FIG. 2 is a side view of the machine shown in FIG. 1.
Figure 3:
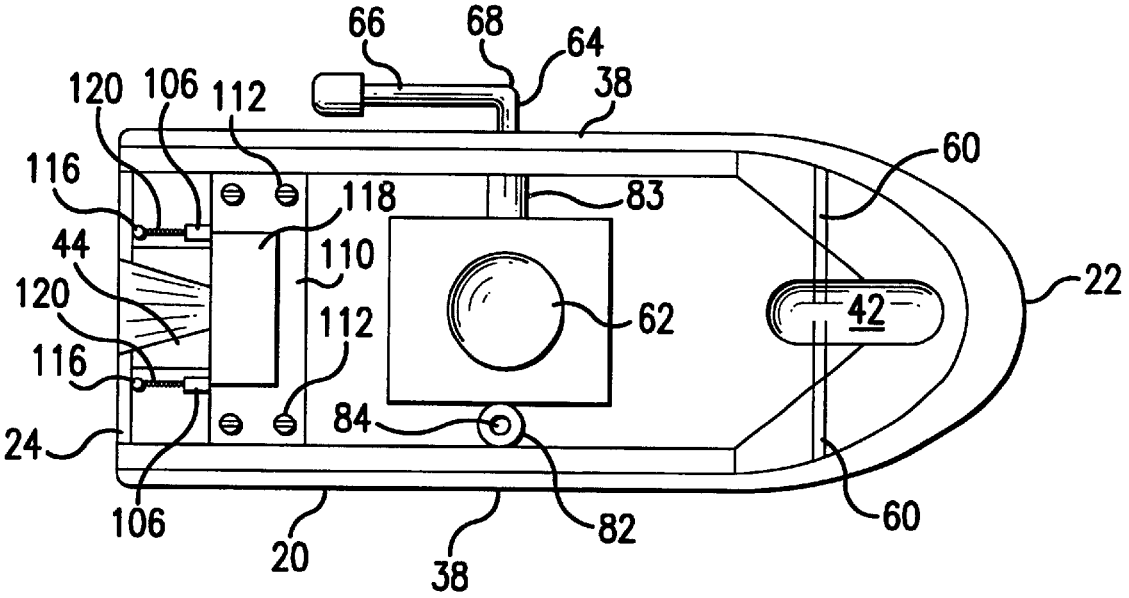
FIG. 3 is a bottom view of the machine shown in FIG. 1.

Referring now to FIGS. 1–3, a preferred specific embodiment will be described. The novel machine consists of the following parts arranged and cooperating in the following manner. A base member 20 is provided having the shape of a boat shell inverted with a prow 22 at the forward end and a stern 24 at the rear end. Mounted on the base member 20 is a carriage 30 which houses a squeegee 32 and a pusher 34. The carriage 30 rides in grooves 36 on formed on the sides 38 of the base member 20 to enable the carriage 30 to travel from adjacent the prow 22 to adjacent the rear or stern 24. After assembly, the slots or grooves 36 are blocked 37 at the rear end to prevent the carriage 30 from coming off the base member 20 after assembly. At the prow or forward end 22 of the base member 20, the upper surface 26 is cutout in a hexagonal shape 40 to receive an engraved plate containing designs in the manner known in the prior art. A finger hole 42 is also formed in the upper surface 26 intersecting with the hexagonal cutout 40 to enable easy removal of the engraved plate. A slightly raised rib 48 runs longitudinally along the base member in the cutout 40 to provided reinforcement for the engraved plate. The rear end 24 of the base member 20 has a cutout 41 in which is assembled to the undersurface of member 20, a finger holding plate 44 and a finger bearing plate 46. Plates 44 and 46, respectively, are spring biased to assume repose positions most upwardly and most rearwardly. The rear end of the cutout 40 has a pair of ramps 50 that raise the squeegee in the manner known in the art. The rear end of the base is cutout at 52 to accommodate the finger plates 44 and 46.

Figure 20:
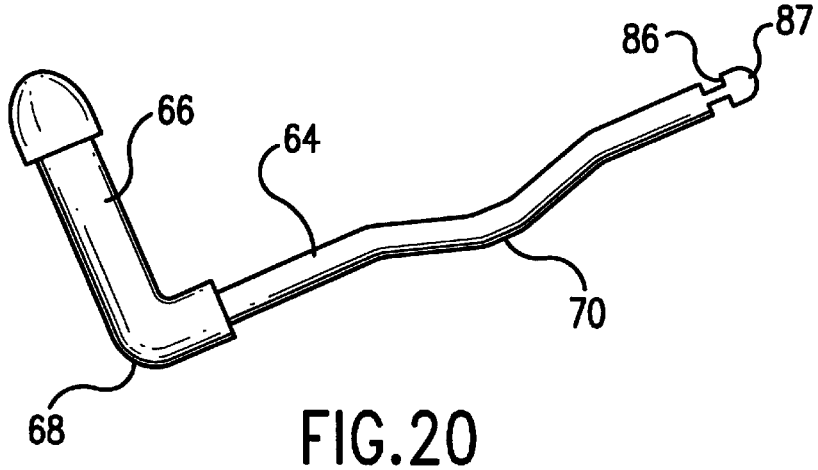
FIG. 20 is a perspective view of the crank.

Looking particularly at the bottom view of the assembled machine, as seen in FIG. 3, one sees the underneath surface of the base member at the forward end. The underneath part of the finger hole 42 which is reinforced with transverse ribs or webs 60. Mid ships, so to speak, one sees a suction cup 62 in the form of a square of resilient material such as rubber. A crank 64 journalled in the sides 38 of the base member 20 interacts with the suction cup 60 to lock the machine down on a smooth surface during use. The crank 64 via a right angle bend 68 defines a handle 66 which lies along one of the sides 38 of the base member 20. The main run of the crank 64, see FIG. 20, defines a bent section 70 that passes through a hole 72 in a plate 74 fixed to and depending from pad 62. The underneath portion of the base member 20 is formed with a central skirt 76 defining a square box that is open at its free edge 78 upon which sits the pad 60. When the crank 64 is rotated by its handle 66, the pad 62 is either forced away from the skirt 76 or drawn to it. When forced away, it seals against a smooth surface. Within the skirt 76 is a circular skirt 77 within which are two spaced channels 80 that receive the opposite ends of the plate 74 to hold it stationary. A threaded boss 82 is formed integral with the base member, and a set screw 84 interacts with a reduced section 86 adjacent the end of the crank 64 to hold it in the assembled position. A bushing 83 holds crank 64 between side 38 and skirt 76. Both skirts 76 and 77 have bores or holes that axially align with shaft 64. Also, there is a bore 85 in side 38 opposite handle 66 to receive the ball end 87 of shaft 64.

Figure 24:
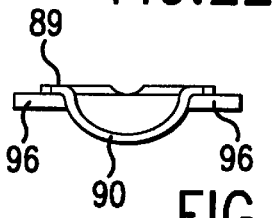
FIG. 24 is an end view of the finger holding plate.
Figure 23:
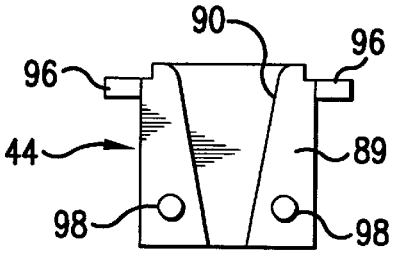
FIG. 23 is bottom view of the finger holding plate.
Figure 26:
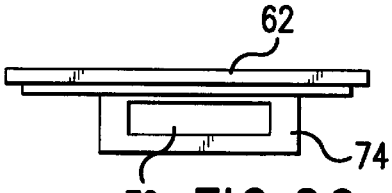
FIG. 26 is a side view of the suction pad.
Figure 25:
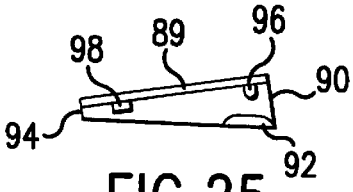
FIG. 25 is a side view of the finger holding plate.
Figure 27:
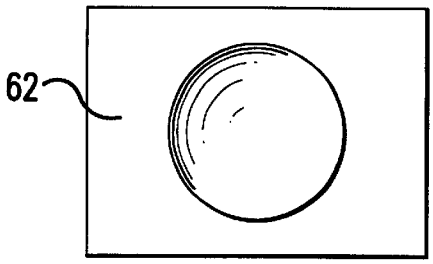
FIG. 27 is a bottom view of the suction pad.
Figure 12:
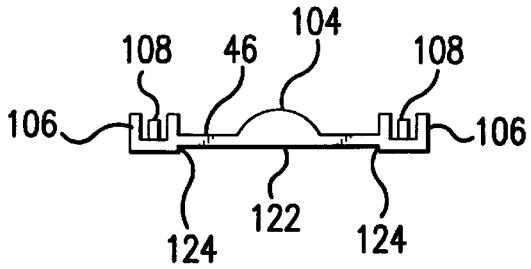
FIG. 12 is an end view of the abutting plate.
Figure 11:
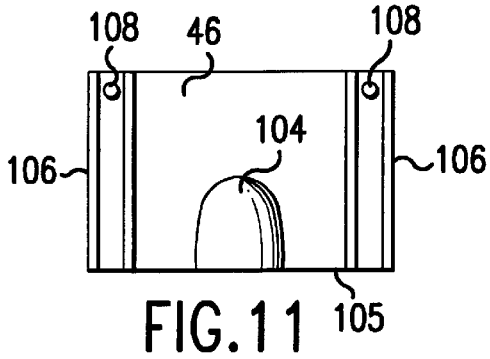
FIG. 11 is a top view of the abutting plate.

At the rear end 24 of the base member 20 is assembled a finger or digit holding plate 44, shown in detail in FIGS. 23–25, which consists of a flat plate 89 having a central curved recess 90 that tapers upwardly from rear 92 to front 94, and is adapted to hold, e.g. the end of a finger with the nail exposed up. At the rear, a hemi-cylindrical projection 96 extends to either side on the under surface. Adjacent the front, a pair of spaced studs 98 project downwardly. The plate 44 is mounted on the base member 20 to extend from the rear 24 of base member 20 extending toward the front, just below the undersurface of the base member 20. The base member 20 defines a pair of spaced ribs 100 each of which has a shoulder 102 spaced slightly forward of the rear. Forward of shoulders 102, the plate 46 lies and extends under the surface of base member. Plate 46 is shown in FIGS. 11 and 12 in detail. Plate 46 consists of a flat plate with a central hump 104 at its rear edge 105 and a pair of U-channels 106 facing upward along opposite longitudinal edges. At the end of each channel in the forward direction is a post 108 fixed to plate 46.

Figure 4:
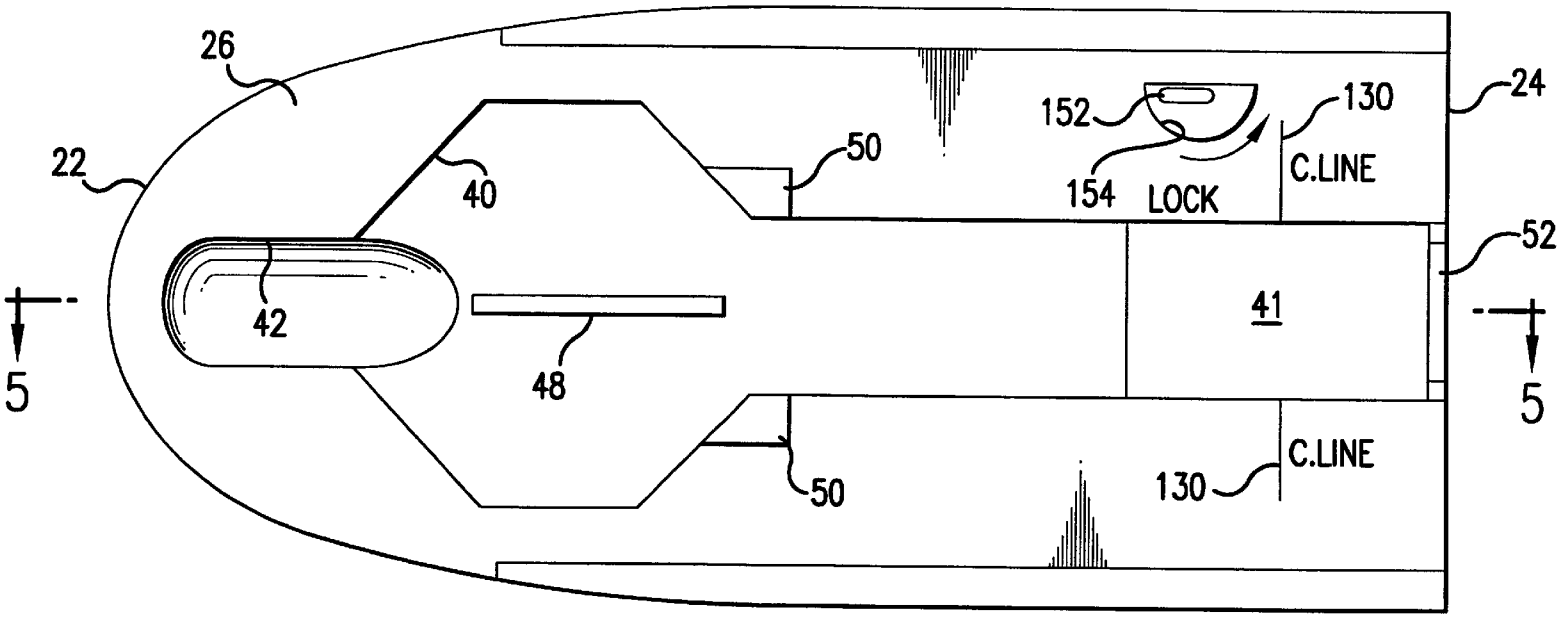
FIG. 4 is a top plan view of the base member of the machine.
Figure 5:
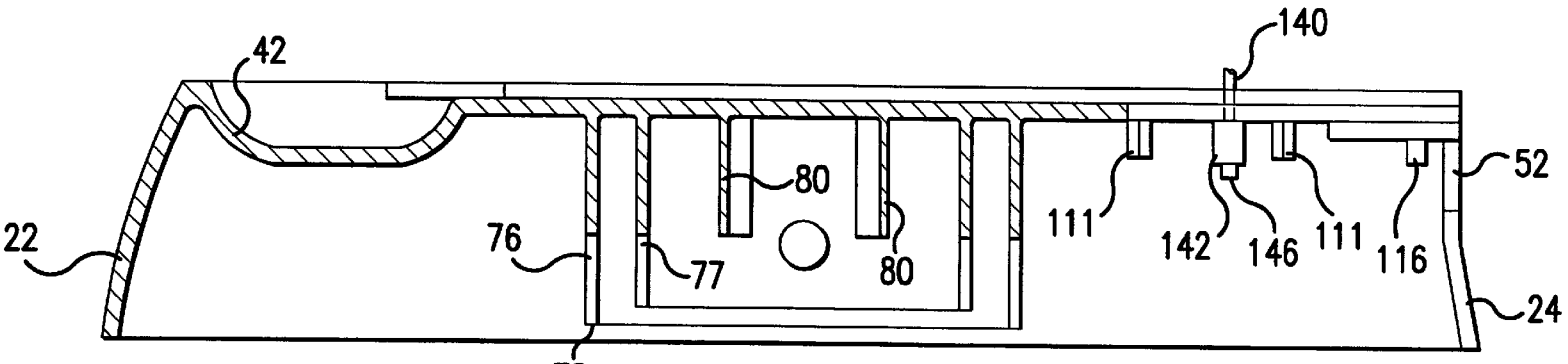
FIG. 5 is section through FIG. 4 taken along line 5—5.
Figure 6:
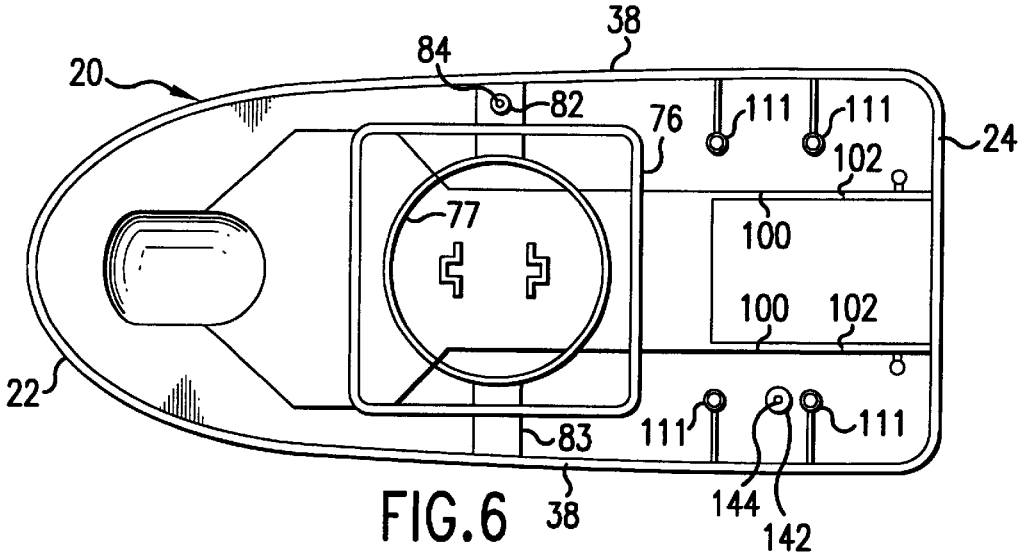
FIG. 6 is a bottom view of the base member.
Figure 21:
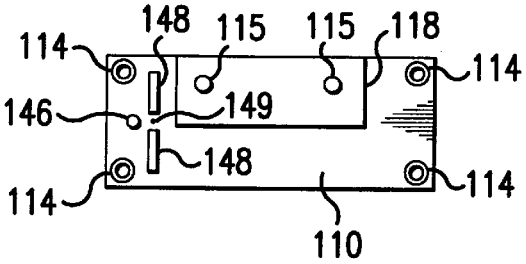
FIG. 21 is a bottom view of the securing plate.
Figure 22:
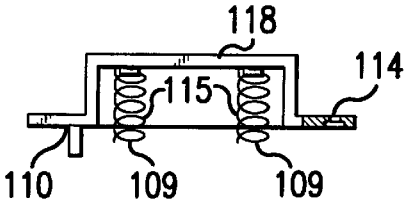
FIG. 22 is an end view of the securing plate.
Figure 10:
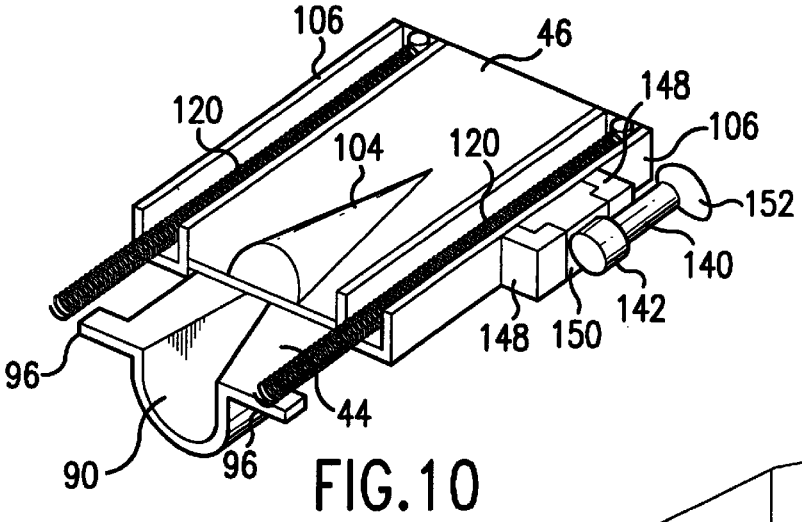
FIG. 10 is a partial assembly view of the finger holding plate and abutting plate and lock.
Figure 8:
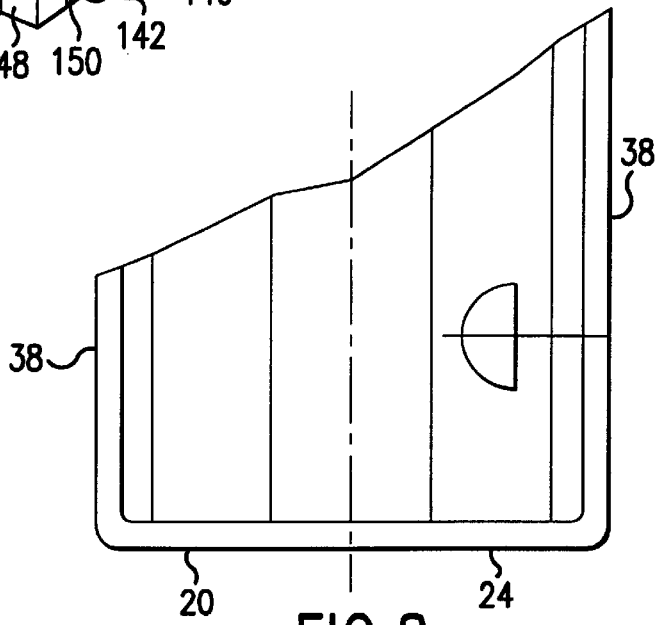
FIG. 8 is a top plan of the end of the base member.
Figure 9:
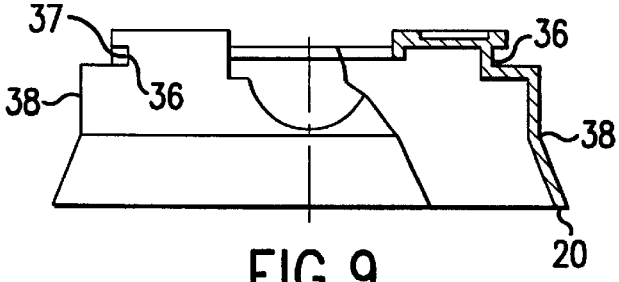
FIG. 9 is a rear view of the base member partly broken away.
Figure 14:
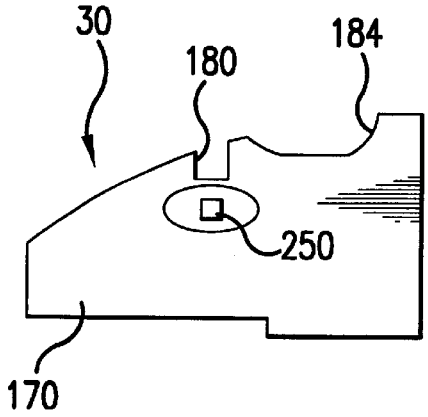
FIG. 14 is a side view of the carriage.
Figure 13:
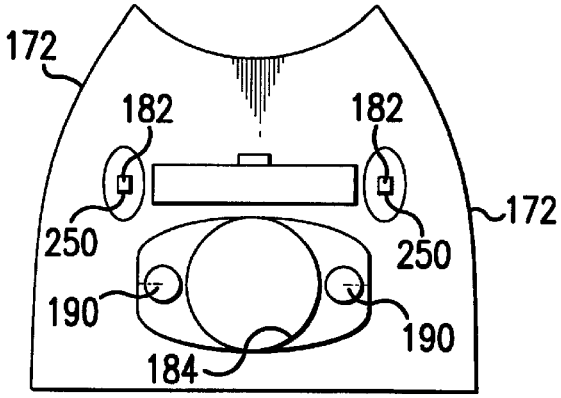
FIG. 13 is a top view of the carriage.
Figure 17:
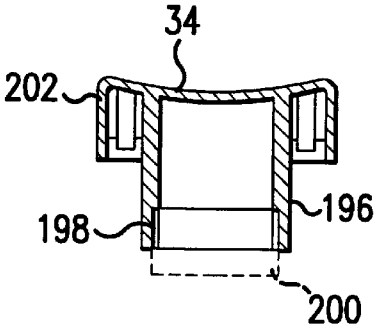
FIG. 17 is a section through the pusher.
Figure 15:
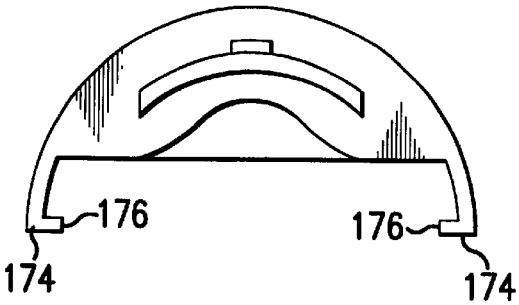
FIG. 15 is an end view of the carriage.
Figure 18:
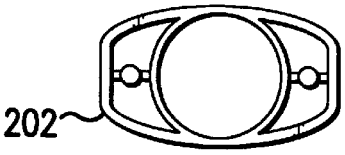
FIG. 18 is a bottom view of the pusher.

Plates 44 and 46 are assembled to the underside of base member 20 by means of a cover plate 110 that is attached to the underside of base member using four screws 112 that pass through four holes 114 defined in plate 110 and secure to threaded bosses that are formed integrally as part of the base member 20. The assembly of plates 44 and 46 is shown in FIG. 10. The U-channels of plate 46 lie just outside or outboard of the ribs 100 so that plate 46 is free for longitudinal fore and aft movement. A pair of posts 116 are integrally formed as part of base member 20. Tension springs 120 are wrapped around posts 108 at one end, lie in the U-channels 106 and are wrapped around the posts 116 which are longitudinally aligned. The springs 120 bias the plate 46 rearward so that the rear edge 105 rests against shoulders 102. The undersurface of plate 46 has a central raised section 122 with shoulders 124 defined along either side. The plate 44 has a transverse dimension equal to the transverse dimension of the section 122, and the forward part of plate 44 fits against the underneath side of plate 46 within the space between shoulders 124. When the cover plate 110 is screwed onto the base member, compression springs 109, shown in FIG. 22, are interposed between studs 115 on the upper surface of the box-like section 118 of plate 110 and the studs 98 to bias the plate 44 upwardly. By the arrangement described, one may place a finger in plate 44 with the end of the finger bearing against the hump 104. Since plate 46 is slidably movable in the longitudinal direction, one can push against the hump 104 until the center of the nail is precisely aligned with a scored line 130, see FIG. 4, transversely marked on the upper surface of the base member. At the same time, depending upon the thickness of the finger, one can depress plate 44 downwardly against the influence of the compression springs 109 to adjust the vertical level of the fingernail.

When one achieves the desired or optimal position, the machine provides a way to lock plate 44 against further movement. To this end, a shaft 140 is pivotally mounted in the surface of the base member 20, passing to either side. Shaft 140 below the base member 20 has an enlarged section 142 that is eccentric to the shaft axis. The lower end of the shaft 140 has a reduced section 144 journalled in a hole 146 in plate 110. Also, projecting from the surface of plate 110 are two flat projections 148 aligned in a single plane, but spaced apart. The eccentric section 142 is situated adjacent the space 149 between projections 148, but withdrawn from them so that only when the enlarge off-center area of the section 142 is nearest the projections 148 does it intrude into the space 149. A plate 150 having cutout edges to fit closely against projections 148 on the side remote from section 142 lies in the space 149 between the projections 148. When the off-center area of section 142 intrudes into the space 149, it urges the plate 150 normally away from projections 148. Since one of the channels 106 lies in proximity with the projections 148 and plate 150, with small clearance, whenever section 142 urges plate 150 away from the projections 148, an interference fit is effected between section 142, pressure plate 150 and channel 106, preventing channel 106 from further movement until relieved by rotating section 142. The portion of shaft 140 above the surface of base member 20 is fixed to a turn handle 152 to be able to manipulate shaft 140 from above and thereby lock plate 46 against movement. Turn handle 152 is located in a shallow well 154 of D-shape, as will be best seen from FIG. 4, and is manipulated between a locked position and an unlocked position.

Figure 16:
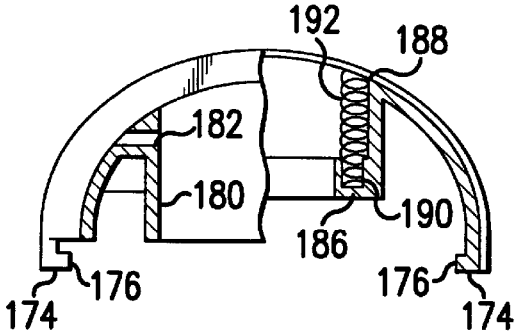
FIG. 16 is a transverse section of the carriage taken at different planes on the left and right sides.

The carriage 30 slides along the base member 20 and carries a squeegee 32 and a pusher 34. Carriage 30, viewed from the side, see FIG. 14, look a bit like an old shoe. Carriage 30, see FIGS. 13–16, is an integrally molded piece with bores and cutout as follows. The main body 170 includes sides 172 which terminate at their lower edges with side guides 174 having in-turned horizontal elongated strips 176 which are received in the slots or grooves 36 in the sides of base member 20 to hold carriage on the base member 20 while it slides to and fro. There are two through bores arranged one in front of the other that penetrate through carriage 30 from top to bottom. The front through bore 180 is elongated transversely across the carriage 30. Bore 180 is intercepted by lateral smaller bores 182, see the left side of FIG. 16, one on each side nearer the top. The second bore 184, see the right side of FIG. 16, is more uniform, circular at its lower end 186 and enlarged laterally at its upper end 188. In the enlarged area there is located laterally spaced wells 190 with compressions springs 192 mounted in wells 190. A pusher member 34, molded with a circular shaft 196 with a recess or receptacle 198 at its lower end to receive a resilient transfer pad 200, and a top of oblong shape 202 with depending pins that are received in and cooperate with the compressions springs 192, simply rests in the bore 184. The arrangement makes it easy to operate and remove for cleaning.

Figure 19:
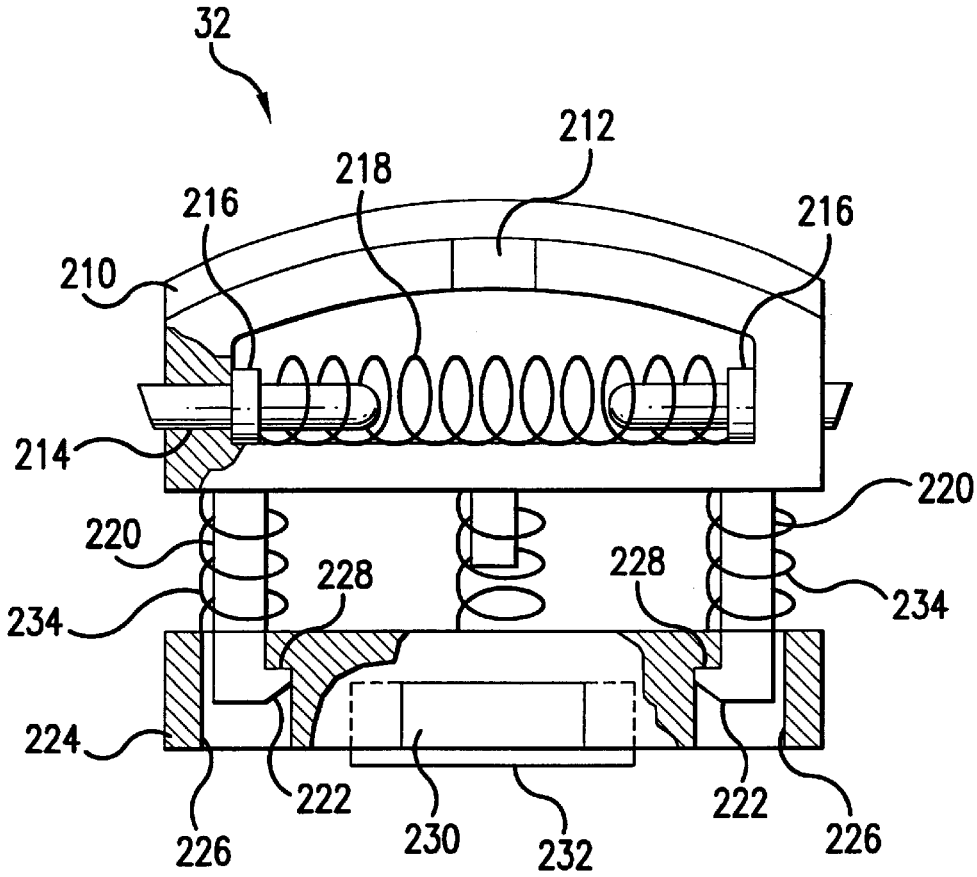
FIG. 19 is an assembly view partly broken away showing the squeegee.

The squeegee 32 is shown in detail in FIG. 19, and consists of an upper yolk 210 having a small central projection 212 facing forward for orientation. A square cross section bore 214 is formed in each side and a collared pin 216 with one end of square cross section fitting in each bore 214. The other ends of pins 216 are round cross section. A compression spring 218 extends from one collar to the other biasing the pins 216 outward, as shown. Depending from the bottom crossbar of the yolk are two spaced legs 220 terminating on their lower ends with inward facing feet 222. A doctor blade holding plate 224 with corresponding bores 226 defining inner shoulders 228, engages with and hold the legs 220, as shown. Plate 224 has a dovetail joint with a retaining plate 230, as known in the art, to secure a doctor blade 232 in a projecting operational position. Springs 234 on legs 220 urge the plate 224 away from the yolk to provide the appropriate bias. The squeegee is placed in the first bore by pressing into the bore until the pins snap into the square cross section lateral smaller bores. At this time, the springs 234 are loaded putting the doctor blade under the correct tension to perform effectively. To release the squeegee 34, there are provided lateral recesses 250 on each side, each covered with a deformable plastic patch 252, which in turn is coupled to a pin, not shown, that is resident in the smaller bores 182. When the squeegee is snapped into position, the pins are retracted. However, when one presses on the plastic patches, the pins displace the collared pins 216, and the squeegee pops out of carriage for cleaning or inspection.

Although the invention has been shown and described in specific terms, changes and modifications will be evident to those skilled in the art from the teachings herein. Such are deemed to fall within the purview of the invention as claimed.

What is claimed is:

1. Hand operated self-contained apparatus for applying an image on a nail of a person's digit or an object comprising:

an integrally molded base on which is established a reference point, a supporting area for receiving an image creating plate containing at least one image for creating thereon an image composed of an image defining coating material, a digit or object positioning member for receiving and positioning a person's digit or object relative to the location of the created image, a transfer member mounted on said base movable for transferring a created image from the image creating plate to the person's nail or object, said transfer member including a squeegee for removing excess coating material from an image and a pick up pad for picking up a created image, and said positioning member comprised of one element mounted and biased for movement vertically for holding the end of the digit or object and another element mounted and biased for movement horizontally against which the end of the digit or object abuts.

2. A hand operated self-contained apparatus according to claim 1 wherein a first spring biases the one element upward, and a second spring biases the other element toward the one element.

3. A hand operated self-contained apparatus according to claim 1 wherein said squeegee and said pick up pad are mounted in common.

4. A hand operated self-contained apparatus according to claim 1 wherein the pad is mounted for vertical movement and easy removal.

5. A hand operated self-contained apparatus according to claim 1 wherein latch elements lock the squeegee in said housing in a readily delatchable manner to enable easy removal.

6. A hand operated self-contained apparatus according to claim 1 wherein a lock is provided to lock the other element in a fixed position.

7. A hand operated self-contained apparatus according to claim 1 wherein the transfer member is a carriage that rides in guide slots formed in the base.

8. A hand operated self-contained apparatus according to claim 7 wherein the guide slots are formed in the sides of the base.

9. A hand operated self-contained apparatus according to claim 7 wherein the carriage is provided with a pair of axially aligned bores for receiving portions of the squeegee.

10. A hand operated self-contained apparatus according to claim 9 wherein ejector elements are mounted on the carriage cooperating with the pair of bores to eject the portions of the squeegee received in said bores.

11. A hand operated self-contained apparatus according to claim 6 wherein the lock comprises a pressure plate that is urged against a portion of the other element to effect locking.

12. A hand operated self-contained apparatus according to claim 11 wherein an eccentric shaft is positioned adjacent the pressure plate to actuate the pressure plate.

13. A hand operated self-contained apparatus according to claim 9 wherein the portions of the squeegee are constituted by a pair of pins that are mounted horizontally in a yolk and are biased apart.

14. A hand operated self-contained apparatus according to claim 13 wherein a single spring biases the pair of pins.

* * * * *